US006116462A

United States Patent [19]

Takamura et al.

[11] Patent Number: 6,116,462

[45] Date of Patent: Sep. 12, 2000

[54] VENDING MACHINE IN WHICH AN ARTICLE STORAGE SPACE HAS A SIZE ADJUSTED AND LOCKED BY A GIVEN ONE OF ARTICLES

[75] Inventors: Toshiyuki Takamura, Takasaki; Sakaguchi Haruki, Maebashi, both of Japan

[73] Assignee: Sanden Corporation, Japan

[21] Appl. No.: 09/228,757

[22] Filed: Jan. 12, 1999

[30] Foreign Application Priority Data

Sep. 29, 1998 [JP] Japan ..... 10-275192

[51] Int. Cl.[7] ..... B65H 31/20

[52] U.S. Cl. ..... 221/241; 221/312 R

[58] Field of Search ..... 221/242, 241, 221/68, 92, 303, 304, 312 R, 311

[56] References Cited

FOREIGN PATENT DOCUMENTS 581538 4/1993 Japan ..... 221/312 R

*Primary Examiner*—Kenneth W. Noland

*Attorney, Agent, or Firm*—Banner & Witcoff, Ltd.

[57] ABSTRACT

In a vending machine including an article storage space (3*a*) for stacking articles (A) therein in a vertical direction, a movable spacer (10) is provided for adjusting a size of the article storage space. The spacer is placed in the article storage space movably in a horizontal direction. An urging arrangement (20) urges the spacer towards one end of the article storage space in the horizontal direction. In cooperation with a given one of the articles, a locking arrangement (30) locks the spacer in the first horizontal direction at an optional position determined in accordance with the articles.

18 Claims, 8 Drawing Sheets

VENDING MACHINE IN WHICH AN ARTICLE STORAGE SPACE HAS A SIZE ADJUSTED AND LOCKED BY A GIVEN ONE OF ARTICLES

BACKGROUND OF THE INVENTION

The present invention relates to a vending machine for vending articles, and in particular to a space adjustment device for adjusting a size of an article storage space included in the vending machine.

In a conventional vending machine, articles such as canned, bottled or PET-bottled beverage are stacked and stored in a vertically extending article storage section. The articles in the article storage section are delivered downward one by one by a delivery mechanism provided on the lower end of the article storage section. In such known vending machine, when the article to be vended is changed in length, a size of the article storage section is adjusted in accordance with the length of the article by changing the position of a spacer attached in the article storage section in the depth direction.

In the conventional vending machine, however, since the spacer position change is manually performed, the adjustment of the article storage space is intricate. Additionally, there is a possibility that the spacer is attached to an incorrect position.

SUMMARY OF THE INVENTION

It is therefore an object of the present invention to provide a space adjustment device for use in a vending machine, which obviates the necessity of manually adjusting a size of an article storage space.

It is another object of the present invention to provide a vending machine in which it is unnecessary to manually adjust the size of the article storage space.

Other objects of the present invention will become clear as the description proceeds.

According to an aspect of the present invention, there is provided a space adjustment device for adjusting a size of an article storage space which is included in a vending machine and is for stacking articles therein in a vertical direction. The space adjustment device comprises a spacer placed in said article storage space movably in a first horizontal direction, urging means connected to said spacer for urging said spacer towards one end of said article storage space in said first horizontal direction, and locking means coupled to said spacer and cooperated with a given one of the articles for locking said spacer in said first horizontal direction at an optional position determined in accordance with said articles.

According to another aspect of the present invention, there is provided a vending machine including an article storage space for stacking articles therein in a vertical direction and a space adjustment device for adjusting a size of said article storage space. In the vending machine, the space adjustment device comprises a spacer placed in said article storage space movably in a first horizontal direction, urging means connected to said spacer for urging said spacer towards one end of said article storage space in said first horizontal direction, and locking means coupled to said spacer for locking said spacer in said first horizontal direction at an optional position determined in accordance with said articles.

DESCRIPTION OF THE PREFERRED EMBODIMENT

Figure 1:
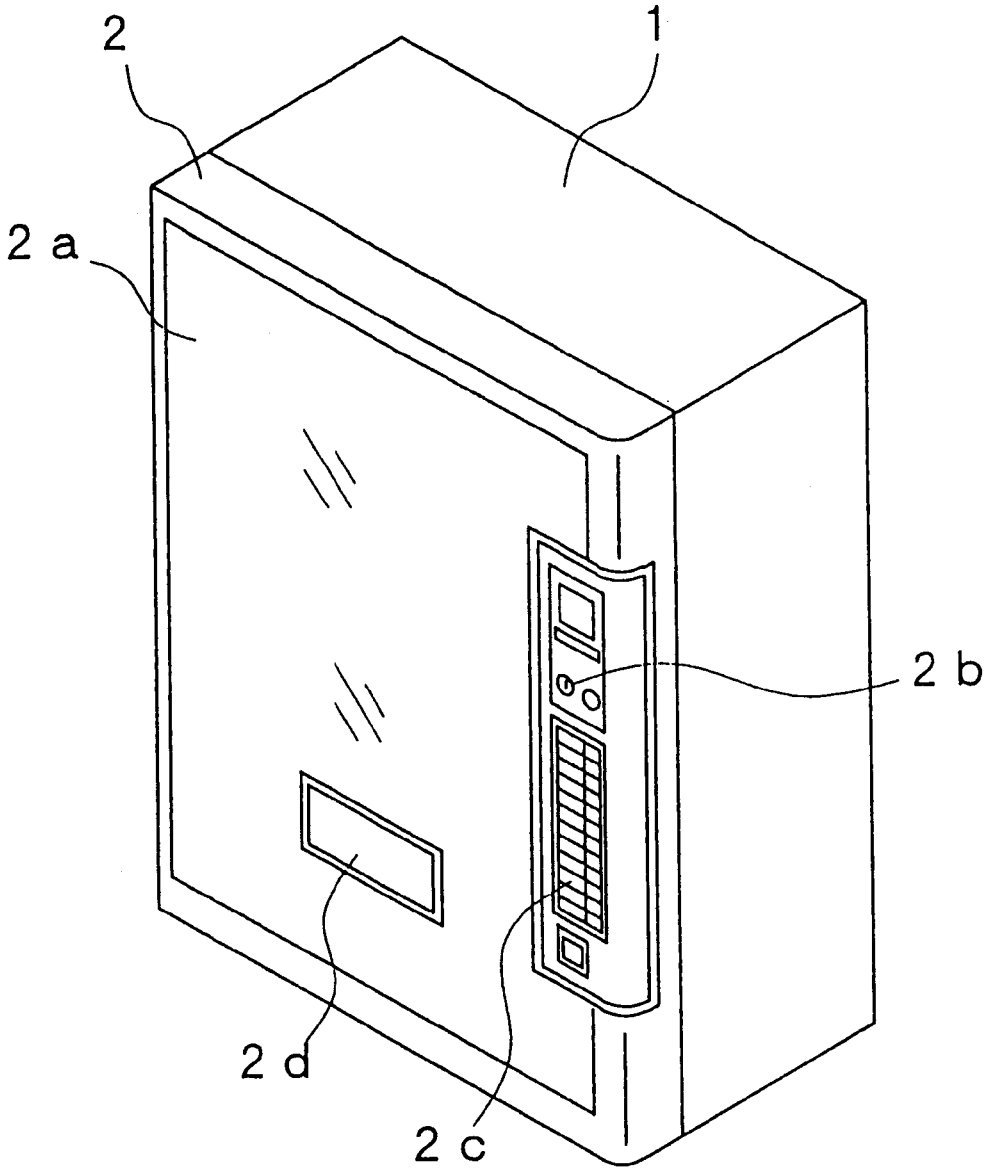
FIG. 1 is a perspective view showing a vending machine according to one embodiment of the present invention.
Figure 2:
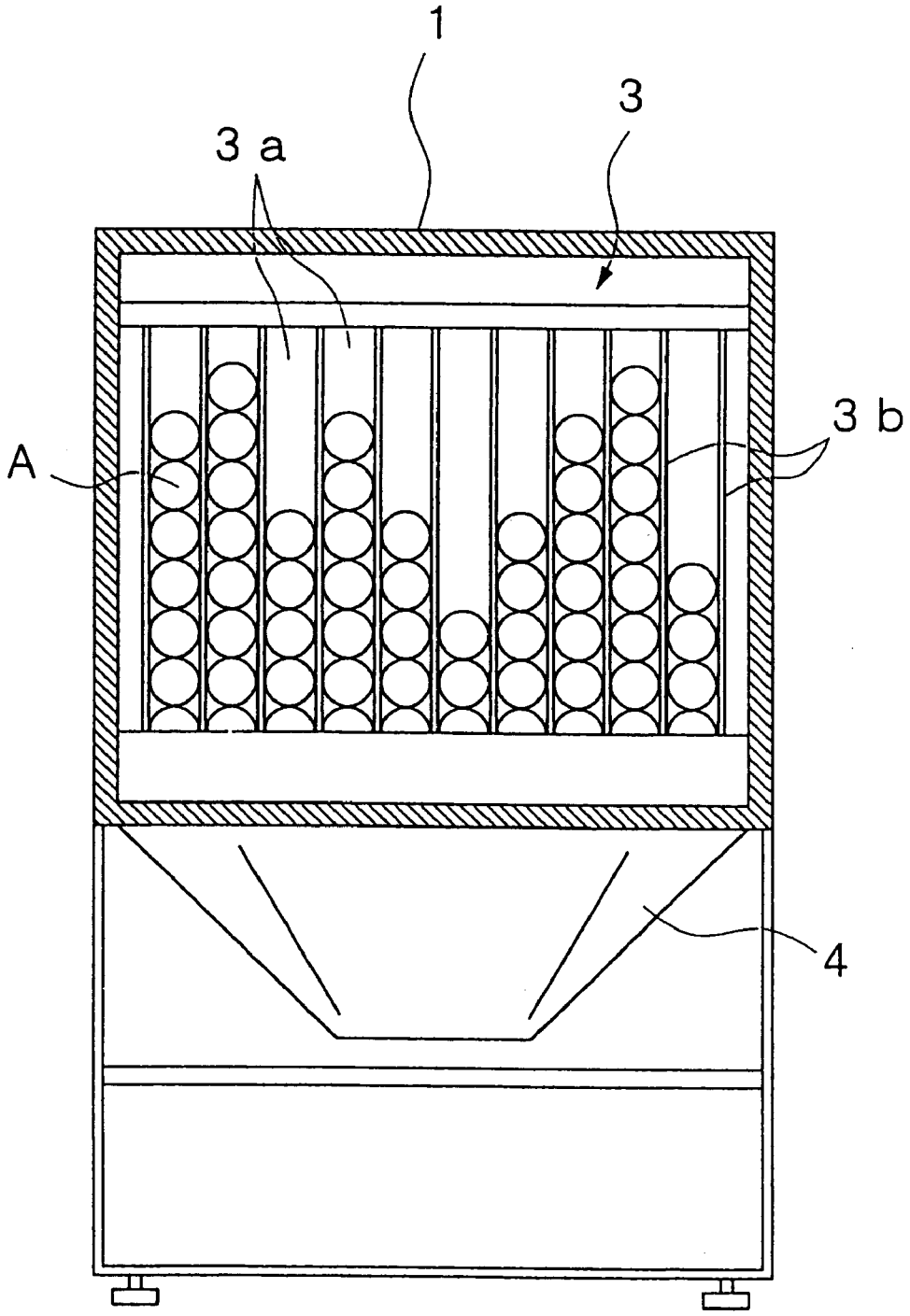
FIG. 2 is a sectional front view of the vending machine.
Figure 3:
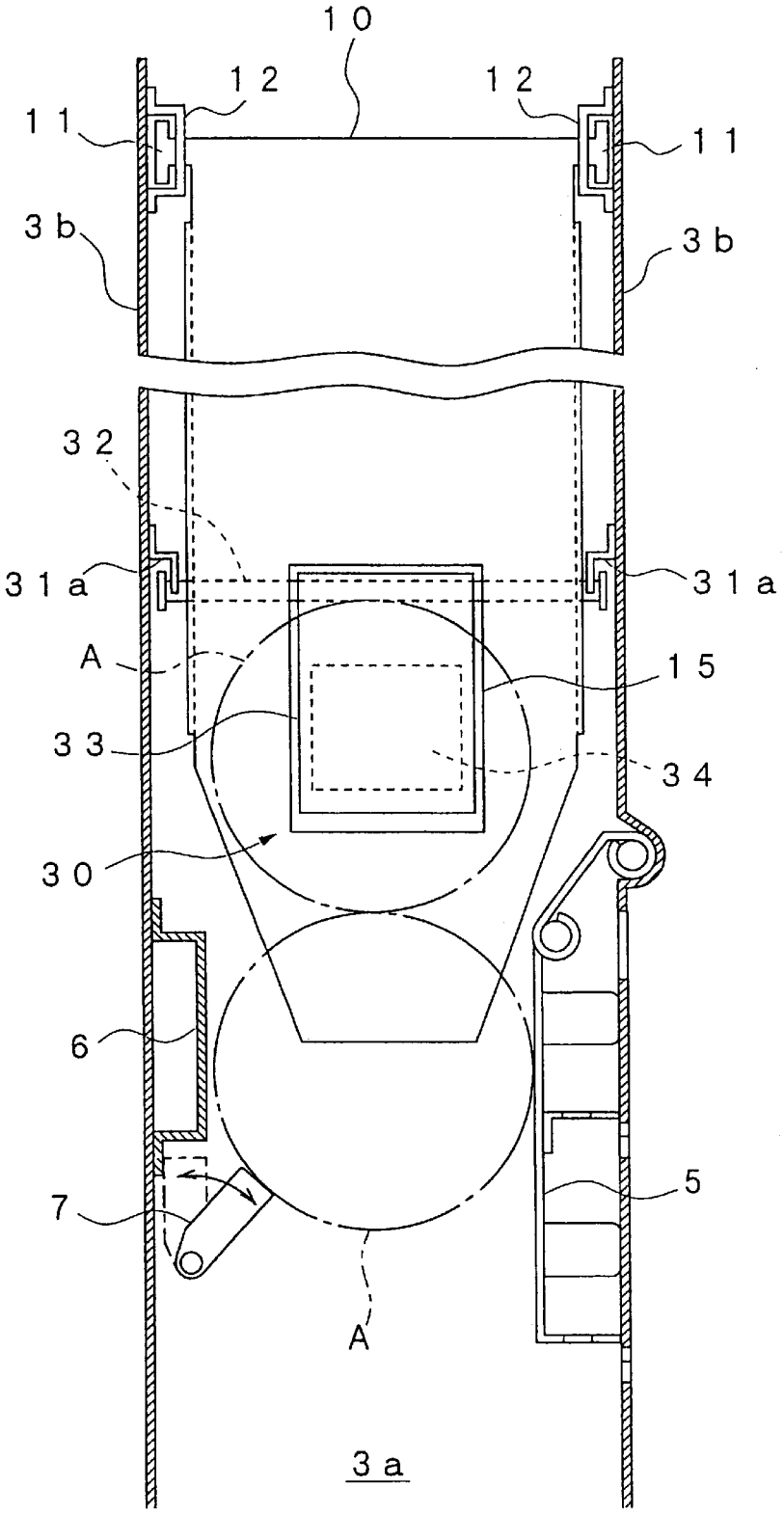
FIG. 3 is a front view of an article storage space adjustment device.
Figure 4:
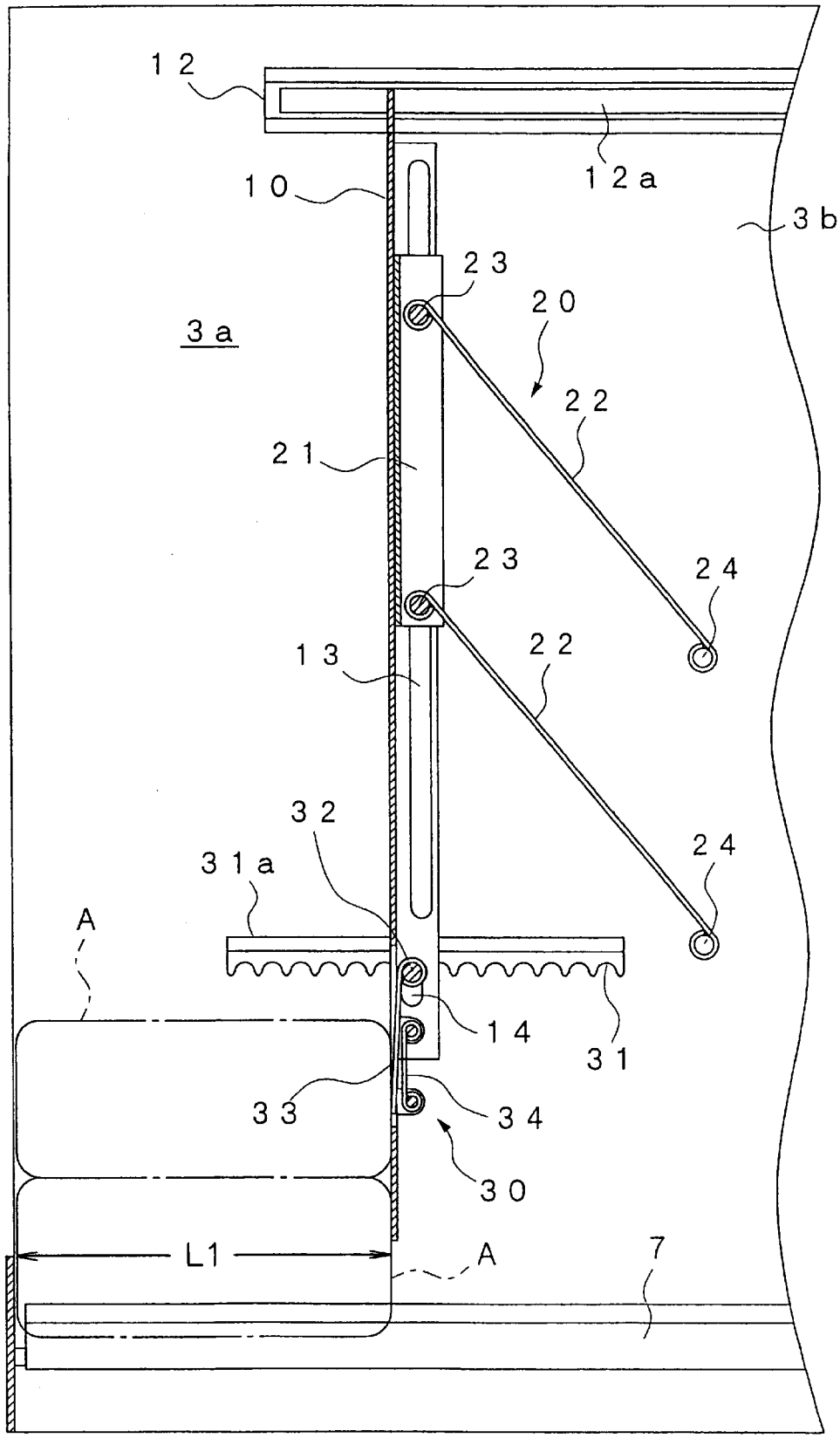
FIG. 4 is a side view of the article storage space adjustment device.
Figure 5:
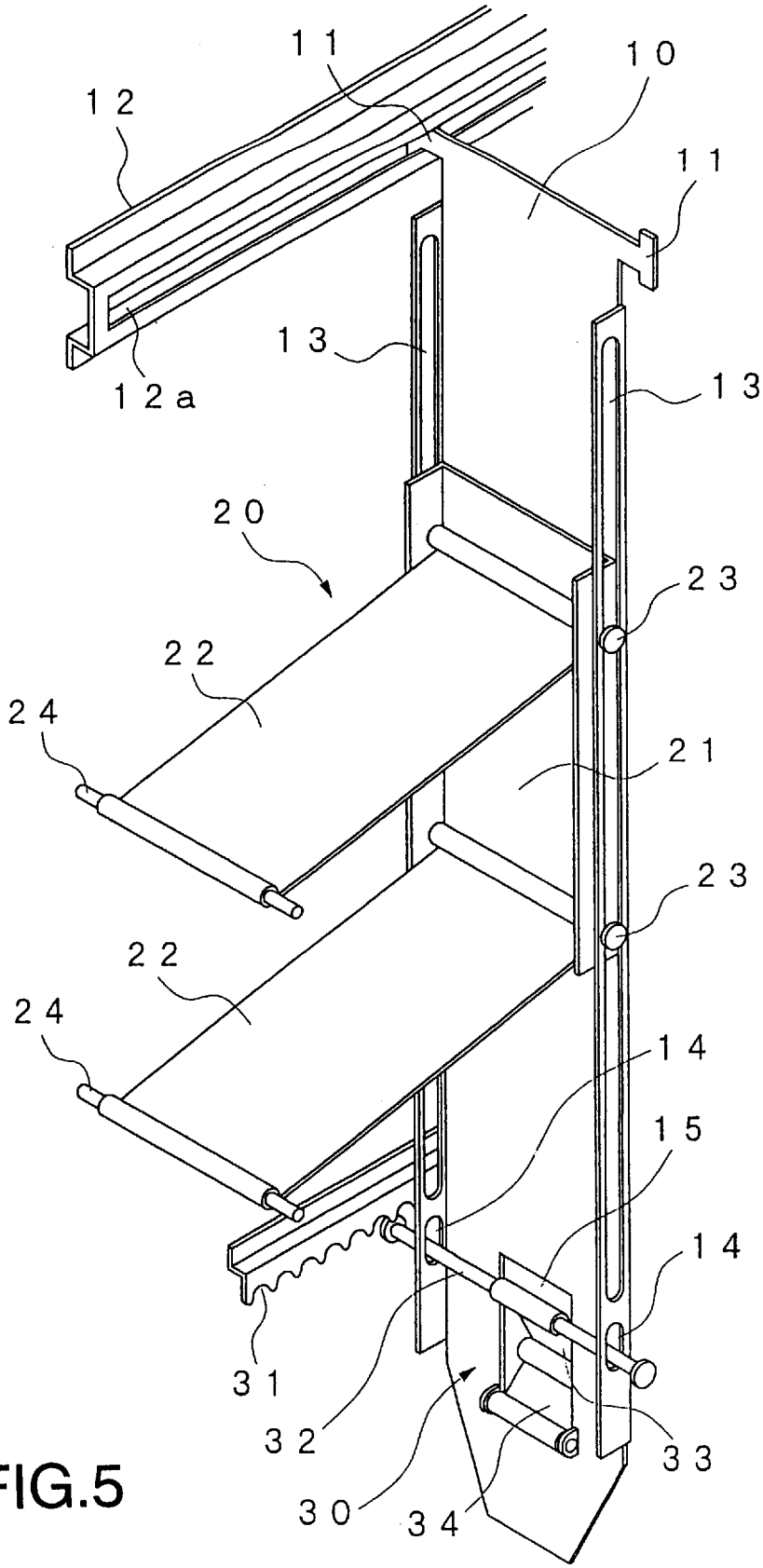
FIG. 5 is a perspective view of the article storage space adjustment device.

Referring to FIGS. 1 and 2, description will be made as regards to a vending machine to which the present invention is applicable. A vending machine shown in FIGS. 1 and 2 comprises a vending machine body 1 having an open front face; an outer door 2 for opening/closing the front face of the vending machine body 1, and an article storage column 3 provided in the vending machine body 1. Arranged on the outer surface of the outer door 2 are an advertisement display panel 2*a*, a coin slot 2*b*, article selection buttons 2*c*, an article output port 2*d*, and the like. The article storage column 3 has a plurality of vertically extending article storage spaces or sections 3*a*, and the article storage sections 3*a* are partitioned from one another by a plurality of side plates 3*b* spaced from one another in a horizontal direction which will be called a second. Moreover, a space adjustment device described later is provided on the lower end of each article storage section 3*a*.

Specifically, articles A such as canned, bottled or PET-bottled beverage are stacked in a vertical direction and stored in each article storage section 3*a* of the vending machine. When the article A of the optional article storage section 3*a* is selected, the lowermost article A in the article storage section 3*a* is dropped downward by a delivery mechanism provided on the lower end of the article storage section 3*a*, and delivered to the article output port 2*d* via a delivery chute 4 in the manner known in the art.

Referring to FIGS. 3–8 in addition, the description will be directed to the space adjustment device provided on the vending machine. The space adjustment device is for adjusting a size of each of the article storage sections 3*a* and comprises a spacer 10 provided movably along a back to forth direction (namely, a first horizontal direction) on a rear side in the article storage section 3*a*, a urging mechanism 20 for urging the spacer 10 toward the front face of the article storage section 3*a*, and a lock mechanism 30 by which the spacer 10 can be locked in an optional position in the back to forth direction of the article storage section 3*a*. Moreover, a movable spacer 5 is attached to one side plate 3*b* of the article storage section 3*a*, and a fixed spacer 6 is attached to the other side plate 3*b*. Furthermore, a delivery piece 7 of the delivery mechanism is disposed below the fixed spacer 6. Each of the movable spacer 5, the fixed spacer 6, and the delivery piece 7 has an operation which is known in the art.

The spacer 10 is formed in a plate shape extending along the vertical direction of the article storage section 3*a*, and engaging pieces 11 as guided portions protruding in the width direction are provided on opposite sides of the upper end of the spacer 10. Specifically, since engaging pieces 11 are engaged in grooves 12*a* of a pair of guide rails 12 attached to upper portions of opposite faces of the side plates 3*b*, the spacer 10 is supported movably along the back to forth direction of the article storage section 3*a*. A combination of the engaging pieces 11 and the guide rails 12 will be referred to as a guiding arrangement.

In the spacer 10, vertically extending first and second elongated holes 13 and 14 are formed at opposite side faces thereof in the second horizontal direction. The first elongated hole 13 is substantially extended from the upper end to the lower end of the spacer 10, and the second elongated hole 14 is formed below the first elongated hole 13. Moreover, a hole 15 for the lock mechanism 30 is formed in the lower end of the spacer 10.

The urging mechanism 20 comprises a slide plate 21 attached, movably in the vertical direction, on the rear face of the spacer 10, and a pair of upper and lower pressing plates 22 each having one end rotatably connected to the slide plate 21. The other end of each pressing plate 22 is rotatably connected to each side plate 3*b*. Specifically, one end of each pressing plate 22 is connected to each of a pair of supports 23 which are passed through side faces of upper and lower ends of the slide plate 21. Opposite ends of each support 23 are inserted, movably along the vertical direction, into the first elongated holes 13 of the spacer 10. Moreover, the other end of each pressing plate 22 is connected to each of a pair of supports 24 attached to the side plates 3*b*. In this case, the pressing plates 22 are supported in parallel with each other, and constantly inclined forward.

The lock mechanism 30 comprises a multiplicity of engagement portions 31 formed on each side plate 3*b*, and a lock pin 32 which can be engaged with a selected one of the optional engagement portions 31 and will be called an engaging member. The lock pin 32 is attached to the spacer 10. The engagement portions 31 are formed in the lower end of a lock plate 31a attached to each side plate 3*b*, and arranged at equal intervals in the back to forth direction of the article storage section 3*a*. Opposite ends of the lock pin 32 are inserted, movably in the vertical direction, in the second elongated holes 14 of the spacer 10, and one end of an operating member or plate 33 disposed in the hole 15 of the spacer 10 is rotatably connected to the middle of the lock pin 32. The operating plate 33 is long enough to extend into the article storage section 3*a*. One end of a rotating plate 34 is rotatably connected to the spacer 10, while the other end thereof is rotatably connected to substantially the middle of the length of the operating plate 33.

In the article storage space adjustment device constituted as described above, as shown in FIGS. 3 and 4, one end of the length direction of an article A second from the bottom abuts on the operating plate 33 of the lock mechanism 30, and the operating plate 33 is thus pushed toward the spacer 10. In this case, the lock pin 32 connected to one end of the operating plate 33 is held in the upper positions in the second elongated holes 14, and engaged with the engagement portion 31 in the corresponding position. In this manner, the spacer 10 is locked, and a depth or space is formed in the article storage section 3*a* corresponding to length L1 of the article A.

Figure 6:
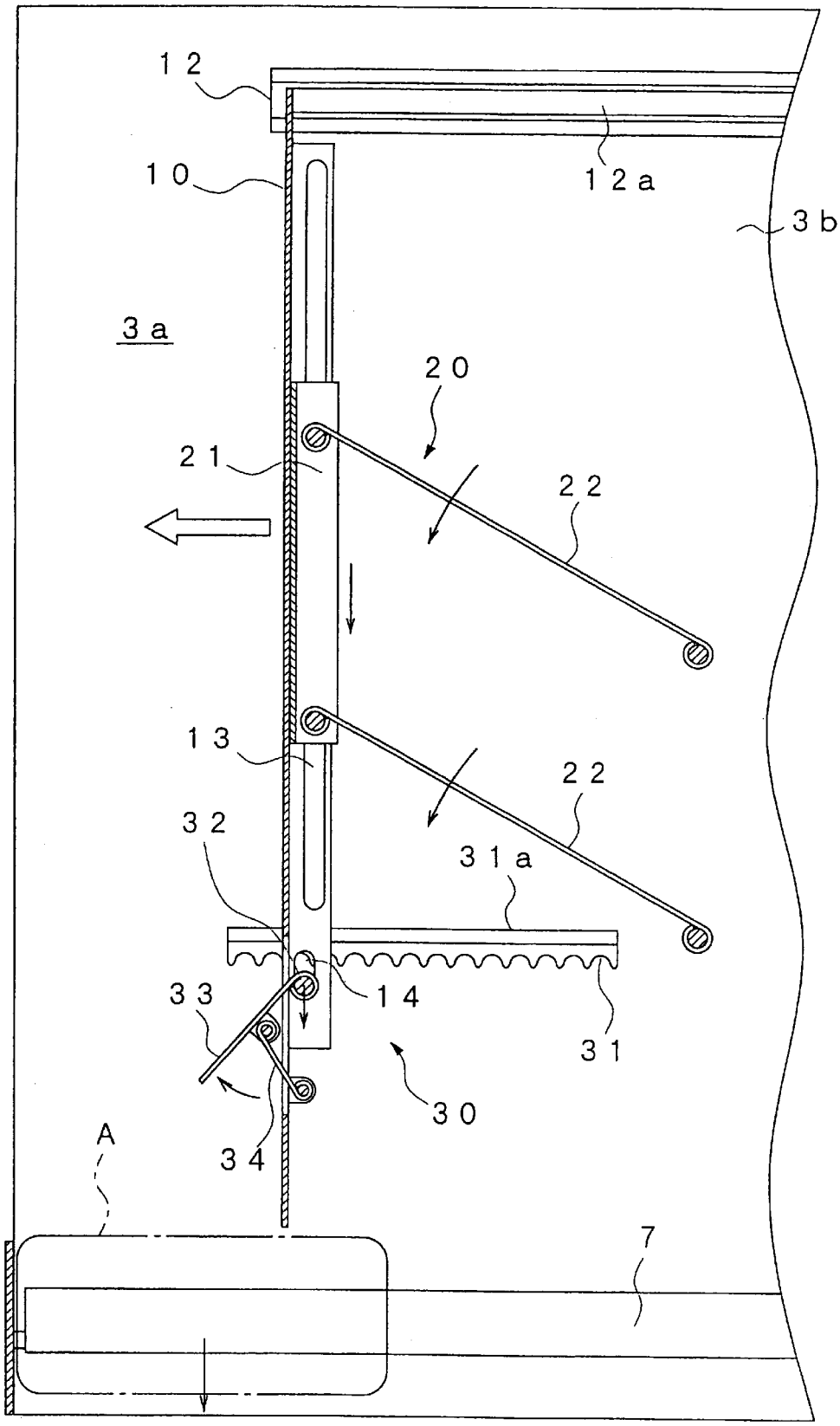
FIG. 6 is an explanatory view showing the operation of the article storage space adjustment device.

Subsequently, when all the articles A in the article storage section 3*a* are delivered, as shown in FIG. 6, the operating plate 33 of the lock mechanism 30 is released from the contact with the article A. The lock pin 32 is moved to the lower positions in the second elongated holes 14 by gravity while rotating the operating plate 33 and the rotating plate 34. Thereby, the lock pin 32 is detached from the engagement portion 31, and the spacer 10 is unlocked. Additionally, the pressing plates 22 move the slide plate 21 downward, and are inclined forward by the weights of the slide plate 21 and the pressing plates 22 of the urging mechanism 20. The spacer 10 is thus pushed to move forward to one end of each guide rail 12. In this case, since the upper and lower spots of the spacer 10 are supported by the mutually parallel pressing plates 22, the parallel movement of the spacer 10 is securely achieved.

Figure 7:
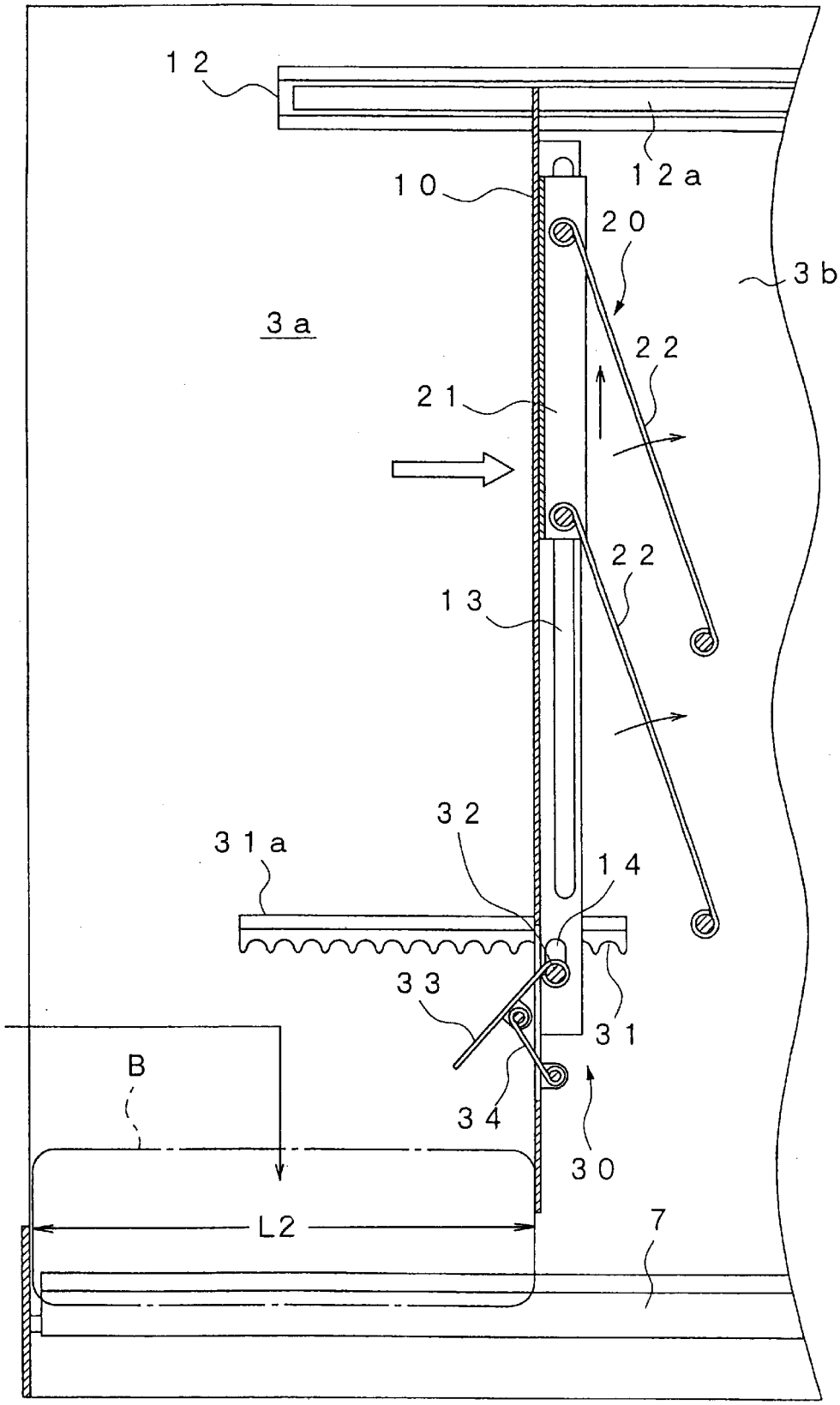
FIG. 7 is an explanatory view showing the operation of the article storage space adjustment device.

Subsequently, as shown in FIG. 7, when an article B longer in the back to forth direction than the article A is inserted into the article storage section 3*a*, the spacer 10 is pushed by the inserted article B to move backward against the urging mechanism 20, so that a depth is formed in the article storage section 3*a* corresponding to length L2 of the article B.

Figure 8:
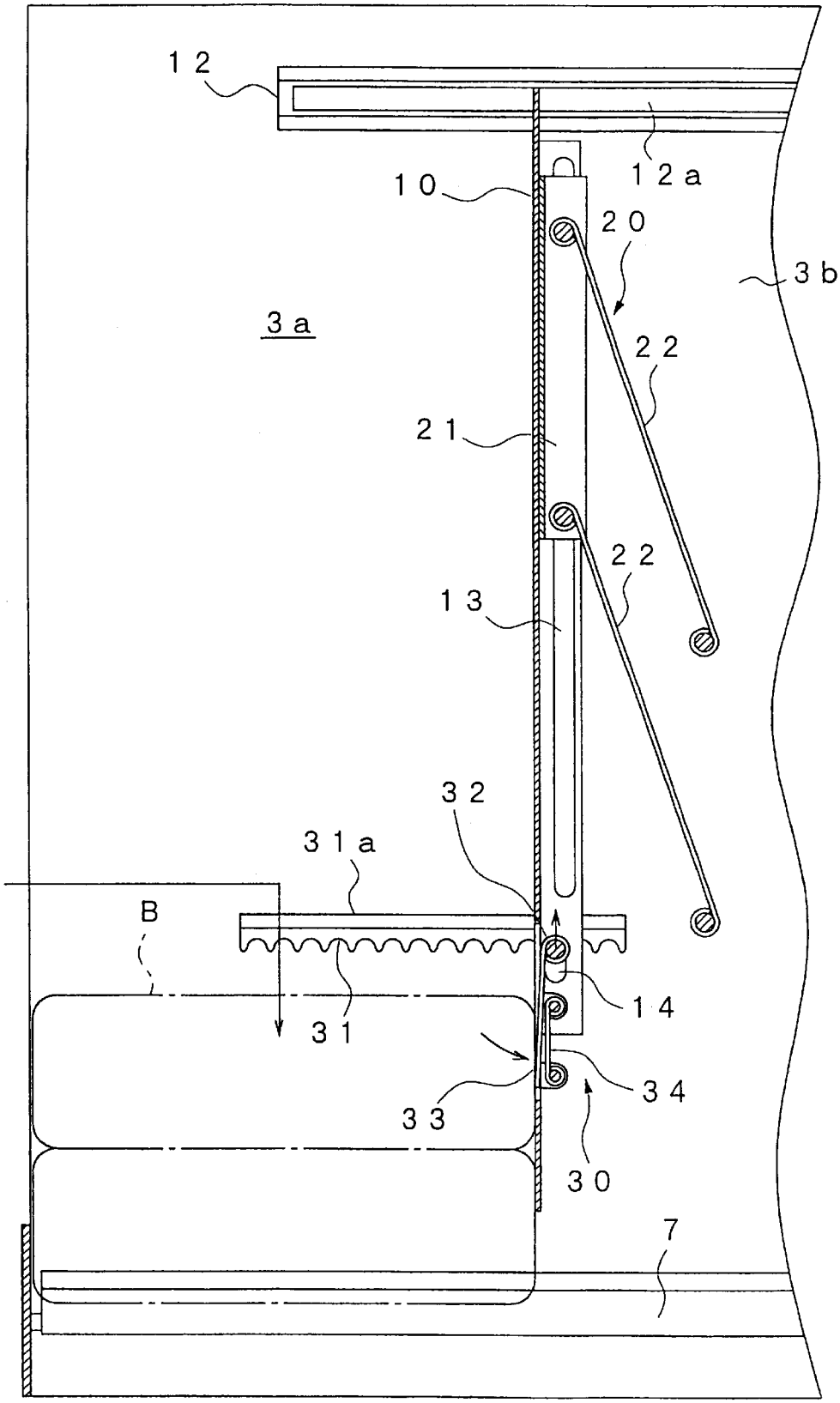
FIG. 8 is an explanatory view showing the operation of the article storage space adjustment device.

Subsequently, as shown in FIG. 8, when the article B second from the bottom is inserted into the article storage section 3*a*, one end of the article B in its length direction abuts on the operating plate 33 of the lock mechanism 30, and the operating plate 33 is pushed toward the spacer 10 by the article B. Thereby, the lock pin 32 of the lock mechanism 30 moves to the upper position in the second elongated hole 14, and engages with the engagement portion 31 in the corresponding position, so that the spacer 10 is locked.

As described above, according to the article storage space adjustment device of the embodiment, the spacer 10 is provided movably in the back to forth direction on the rear-face side in the article storage section 3*a*. Additionally, when the spacer 10 is pushed by the article inserted into the article storage section 3*a*, and moved backward by the length of the article, the lock mechanism 30 is operated by contact with the article to lock the spacer 10. Therefore, the depth of the article storage section 3*a* can automatically be adjusted simply by charging the article storage section 3*a* with articles. In this case, when all the articles are delivered from the article storage section 3*a*, the spacer 10 is moved forward by the urging mechanism 20. Therefore, the position of the spacer 10 can constantly automatically be returned to the initial condition. Thus, manual adjustment operation is unnecessary, and much labor can be reduced. Additionally, conventional disadvantages caused by mistakes in attachment of the spacer can securely be prevented.

While the present invention has thus far been described in connection with a few embodiments thereof, it will readily be possible for those skilled in the art to put this invention into practice in various other manners. For example, the operating plate may be brought in contact with the bottom article or the article third from the bottom. Moreover, the spacer 10 may be pressed or urged by the use of spring or another urging means.

What is claimed is:

1. A space adjustment device for adjusting a size of an article storage space which is included in a vending machine and is for stacking articles therein in a vertical direction, said space adjustment device comprising:

a spacer placed in said article storage space movably in a first horizontal direction;

urging means connected to said spacer for urging said spacer towards one end of said article storage space in said first horizontal direction; and locking means coupled to said spacer and cooperated with a given one of said articles for locking said spacer in said first horizontal direction at an optional position determined in accordance with said articles.

2. A space adjustment device as claimed in claim 1, wherein said urging means comprises:

a slide member attached to said spacer movably in said vertical direction; and a plurality of pressing members each having one end rotatably connected to said slide member with intervals in said vertical direction.

3. A space adjustment device as claimed in claim 2, wherein each of said pressing members has another end rotatably connected to said spacer in such a manner that said pressing members are arranged in parallel with one another, each of said pressing members is disposed in an inclined condition in such a manner that each of said pressing members is inclined toward one of said first horizontal direction by gravity.

4. A space adjustment device as claimed in claim 1, wherein said locking means comprises:

a multiplicity of engagement portions arranged along said first horizontal direction;

an engaging member movably attached to said spacer for realizing engagement with or disengagement from a selected one of said engagement portions; and an operating member connected to said engaging member for moving said engaging member between a first position for said engagement and a second position for said disengagement.

5. A space adjustment device as claimed in claim 4, wherein said engaging member is placed at said first position on presence of said given one in said article storage space and placed at said second position on absence of said given one in said article storage space.

6. A space adjustment device as claimed in claim 1, further comprising guiding means coupled to said spacer for guiding movement of said spacer in said first horizontal direction.

7. A space adjustment device as claimed in claim 6, wherein said guiding means comprises:

a guide rail extending in said first horizontal direction; and a guided portion connected to said spacer and guided by said guide rail in said first horizontal direction.

8. A space adjustment device as claimed in claim 7, wherein said guide rail has a groove extending in said first horizontal direction, said guided portion having an engaging piece engaged with said groove to be movable along said groove.

9. A space adjustment device as claimed in claim 1, further comprising a pair of side plates spaced from each other in a second horizontal direction perpendicular to said first horizontal direction, said side plates defining said article storage space therebetween.

10. A vending machine including an article storage space for stacking articles therein in a vertical direction and a space adjustment device for adjusting a size of said article storage space, said space adjustment device comprising:

a spacer placed in said article storage space movably in a first horizontal direction;

urging means connected to said spacer for urging said spacer towards one end of said article storage space in said first horizontal direction; and locking means coupled to said spacer and cooperated with a given one of said articles for locking said spacer in said first horizontal direction at an optional position determined in accordance with said articles.

11. A vending machine as claimed in claim 10, wherein said urging means comprises:

a slide member attached to said spacer movably in said vertical direction; and a plurality of pressing members each having one end rotatably connected to said slide member with intervals in said vertical direction.

12. A vending machine claimed in claim 11, wherein each of said pressing members has another end rotatably connected to said spacer in such a manner that said pressing members are arranged in parallel with one another, each of said pressing members is disposed in an inclined condition in such a manner that each of said pressing members is inclined toward one end of said first horizontal direction by gravity.

13. A vending machine as claimed in claim 10, wherein said locking means comprises:

a multiplicity of engagement portions arranged along said first horizontal direction;

an engaging member movably attached to said spacer for realizing engagement with or disengagement from a selected one of said engagement portions; and an operating member connected to said engaging member for moving said engaging member between a first position for said engagement and a second position for said disengagement.

14. A vending machine as claimed in claim 13, wherein said engaging member is placed at said first position on presence of said given one in said article storage space and placed at said second position on absence of said given one in said article storage space.

15. A vending machine as claimed in claim 10, further comprising guiding means coupled to said spacer for guiding movement of said spacer in said first horizontal direction.

16. A vending machine as claimed in claim 15, wherein said guiding means comprises:

a guide rail extending in said first horizontal direction; and a guided portion connected to said spacer and guided by said guide rail in said first horizontal direction.

17. A vending machine as claimed in claim 16, wherein said guide rail has a groove extending in said first horizontal direction, said guided portion having an engaging piece engaged with said groove to be movable along said groove.

18. A vending machine as claimed in claim 10, further comprising a pair of side plates opposite to each other in a second horizontal direction perpendicular to said first horizontal direction, said side plates defining said article storage space therebetween.

* * * * *